US005704185A

United States Patent [19]

Lindsay

[11] Patent Number: 5,704,185

[45] Date of Patent: Jan. 6, 1998

[54] JOINT FOR CONNECTING MEMBERS OF A LOAD BEARING TRUSS

[76] Inventor: Pat Lindsay, P.O Box 1806, Spring, Tex. 77383

[21] Appl. No.: 444,295

[22] Filed: May 18, 1995

[51] Int. Cl.[6] ..... E04H 12/00

[52] U.S. Cl. ..... 52/655.1; 52/656.9; 52/665; 52/745.19; 403/175; 403/176; 403/219

[58] Field of Search ..... 52/651.8, 655.1, 52/656.9, 665, 693, 695; 156/304.1, 304.2, 304.5, 297, 298, 296; 403/169, 170, 171, 174, 175, 176, 178, 218, 219, 217, 265, 266, 267

[56] References Cited

U.S. PATENT DOCUMENTS

| | | | |
|---|---|---|---|
| 1,483,602 | 2/1924 | Bloss et al. | 403/175 |
| 1,760,883 | 6/1930 | Moss | 403/217 |
| 1,836,865 | 12/1931 | Norman | 403/175 |
| 1,914,344 | 6/1933 | Ragsdale | 403/170 |
| 2,149,844 | 3/1939 | George | 403/169 X |
| 2,658,776 | 11/1953 | Wilcox | 403/219 X |
| 2,895,224 | 7/1959 | Jones . | |
| 3,100,555 | 8/1963 | Ashton . | |
| 3,268,251 | 8/1966 | Troutner | 52/693 |
| 3,345,792 | 10/1967 | Chandler . | |
| 3,596,950 | 8/1971 | Wipkink et al. | 403/176 X |
| 3,685,862 | 8/1972 | Rudolf . | |
| 3,813,842 | 6/1974 | Troutner | 52/693 |
| 3,985,459 | 10/1976 | Gilb | 52/693 X |
| 4,070,847 | 1/1978 | Madl, Jr. | 403/171 X |
| 4,236,642 | 12/1980 | Klein | 403/175 X |
| 4,324,083 | 4/1982 | Johnson, Jr. | 403/217 X |
| 4,562,681 | 1/1986 | Smith | 52/655.1 |
| 4,637,748 | 1/1987 | Beavers | 403/170 |
| 4,704,836 | 11/1987 | Codd | 52/655.1 X |
| 5,197,818 | 3/1993 | Johnson . | |

FOREIGN PATENT DOCUMENTS

| | | | |
|---|---|---|---|
| 2459331 | 2/1981 | France | 403/171 |
| 1080883 | 8/1967 | United Kingdom | 52/693 |

*Primary Examiner*—Carl D. Friedman
*Assistant Examiner*—Aimee McTigue
*Attorney, Agent, or Firm*—Sughrue, Mion, Zinn, Macpeak & Seas, PLLC

[57] ABSTRACT

A load bearing truss constructed of composite materials. The truss is made of three or more longitudinal load bearing composite members. Bracing for the truss is a combination of perpendicular and diagonal composite cross-members or all diagonal composite cross-members. The longitudinal and cross-members of the truss are joined together by a sandwich constructed joint which encapsulates the joint area as well as spacers, thereby tying all members together.

23 Claims, 17 Drawing Sheets

JOINT FOR CONNECTING MEMBERS OF A LOAD BEARING TRUSS

BACKGROUND OF INVENTION

This invention relates to load bearing composite trusses and more particularly to a joint for connecting members of a load bearing composite truss.

There are numerous applications for load bearing composite trusses. Examples include cantilever truss arms for clarifiers in water/waste water treatment facilities, antennae or electrical transmission towers, bridge supports, roof supports, and lift arms. Most conventional trusses are made of steel. However, there is a current trend to construct trusses of composite materials.

It is known that materials such as fiberglass, reinforced polyester or vinyl ester rods and bars utilizing only longitudinal reinforcements can achieve tensile strengths higher than most steel members of the same size and shape. Also, it is known that composite materials exhibit superior corrosion resistance, low water absorption, non-conductivity, and low maintenance costs.

These materials are used for tent poles, handles and many other simple applications where complex structures, are not required. The drawback to utilizing these superior strength composites in complex structures has been weakness in the crosswise direction, lack of fixity of the members in the joints connecting the members and lack of directional reinforcement in the main members of the truss and the joint.

It has also been known for some time now, that by winding reinforcements in the hoop-wise direction, superior burst resisting strength can be achieved. However, this is usually accomplished at the expense of inferior bridging or spanning properties.

Prior methods to solve these problems have not been successful. For example, in U.S. Pat. No. 2,895,224, U.S. Pat. No. 3,100,555, and U.S. Pat. No. 5,197,818 there is no stabilization of the ends of the cross-members by preventing their ability to rotate in the joint area. In U.S. Pat. No. 3,345,792, the joint also does not prevent the rotation of the cross-members. U.S. Pat. No. 3,685,862 does not provide directional blocking of the cross-members.

SUMMARY OF THE INVENTION

Accordingly, it is an object of the present invention to provide a joint and structure to take advantage of the desired properties of composite members, which joint exhibits superior structural capacity through fixation of the members at the joint area, flexibility of design, flexibility of materials, cost effectiveness, and versatility of uses.

The invention concerns a load bearing composite truss comprising main truss members and encapsulated joints with monolithic characteristics for connecting the truss members. The encapsulated joints include spacers and inner and outer directionally reinforced angles arranged in a sandwich-type construction. The main members of the truss are characteristically long rod-like structures that are made from composite materials with predominately continuous longitudinal reinforcement. The elements of the composite materials can be varied as can the configuration and size of the truss, the joint and the individual members.

DETAILED DESCRIPTION OF THE PREFERRED EMBODIMENTS

Figure 6:
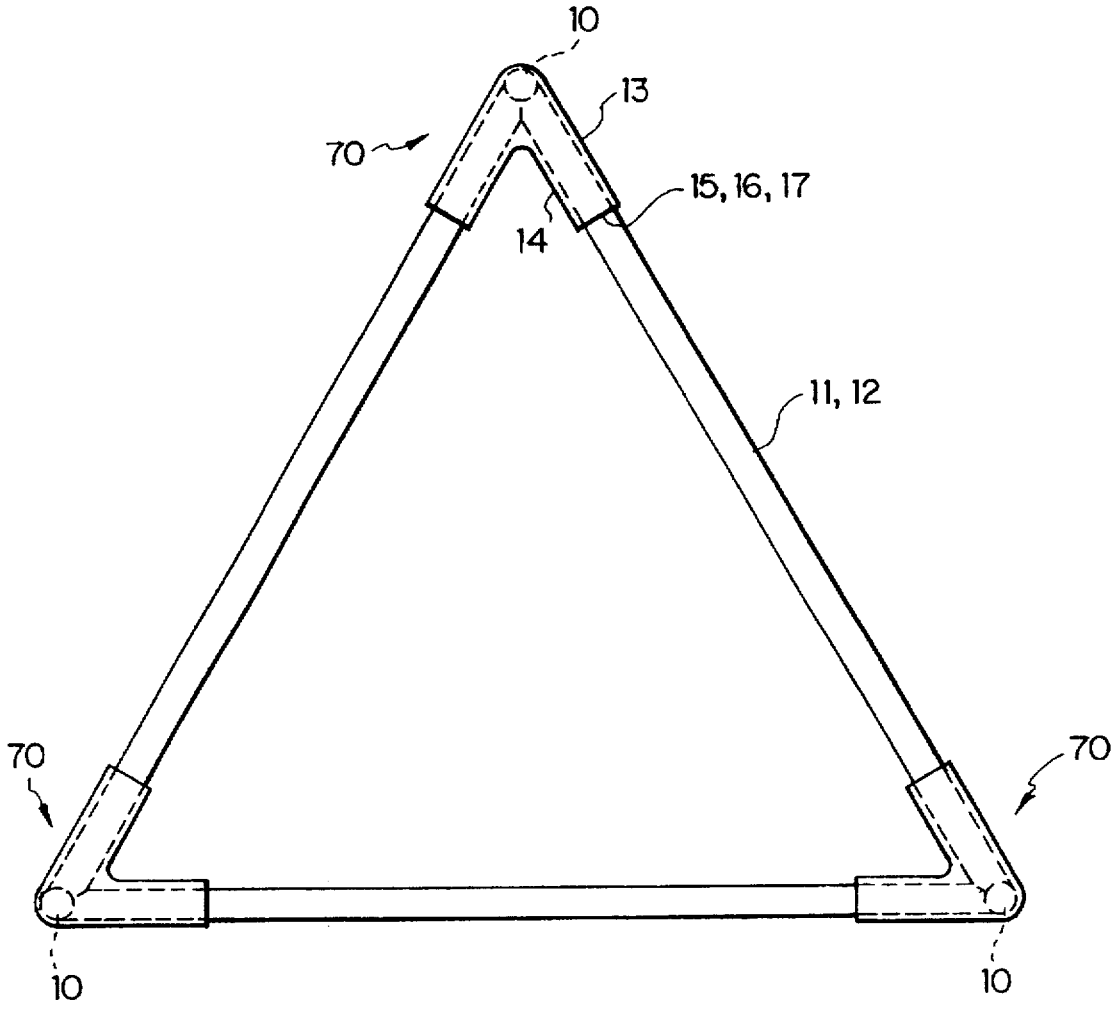
FIG. 6 is a side view of a triangular truss.
Figure 7:
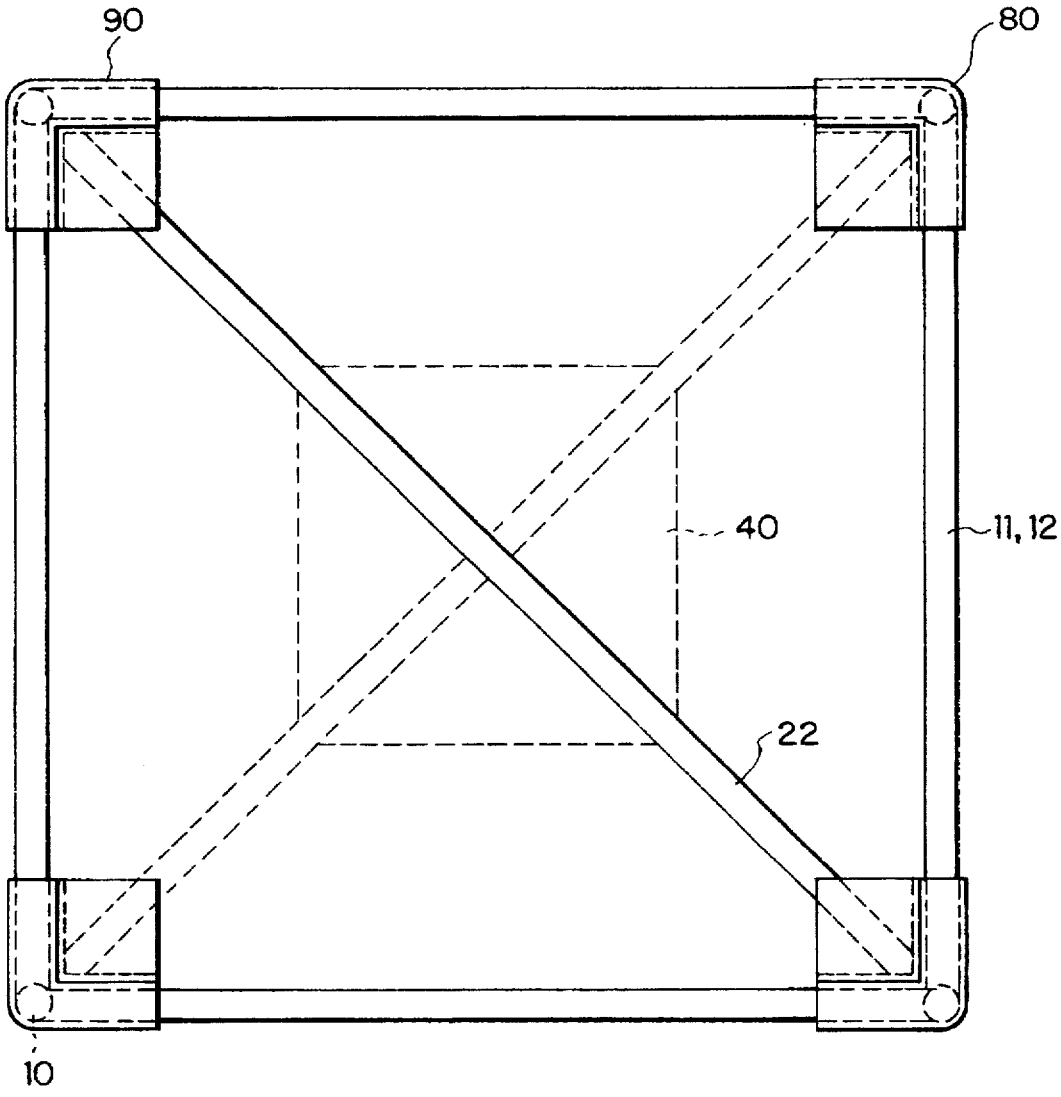
FIG. 7 is a side view of a rectangular truss.

FIGS. 1–5 show the present invention using a variety of different truss configurations and different bracing schemes. FIGS. 6 and 7 show triangular trusses and rectangular trusses, respectively, which can apply to any of the truss configurations and bracing schemes indicated in FIGS. 1–5. These several figures illustrate the versatility of the present invention.

Figure 1:
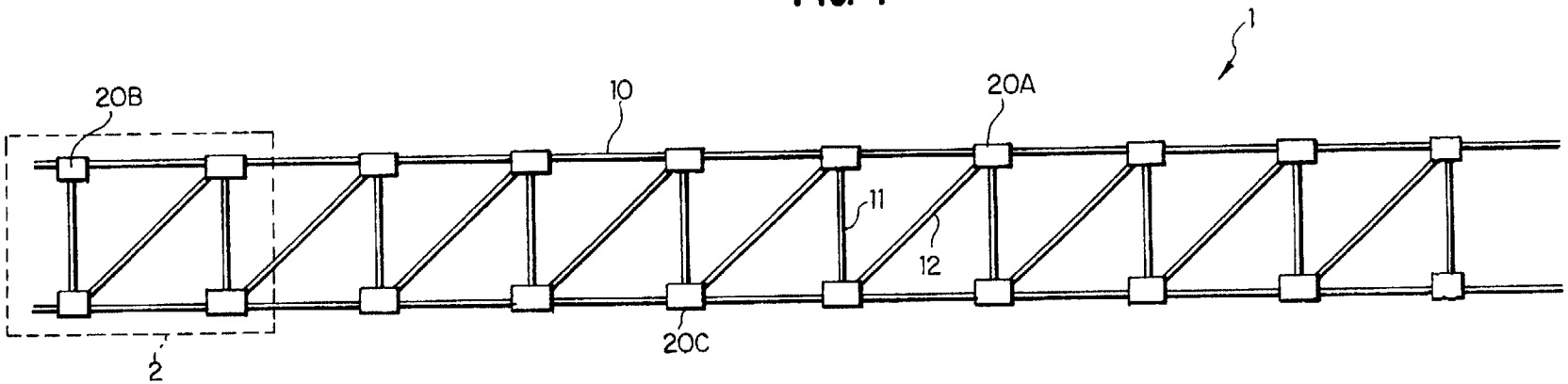
FIGS. 1 is a front elevation of a triangular or rectangular truss with straight and one way diagonal bracing.
Figure 5:
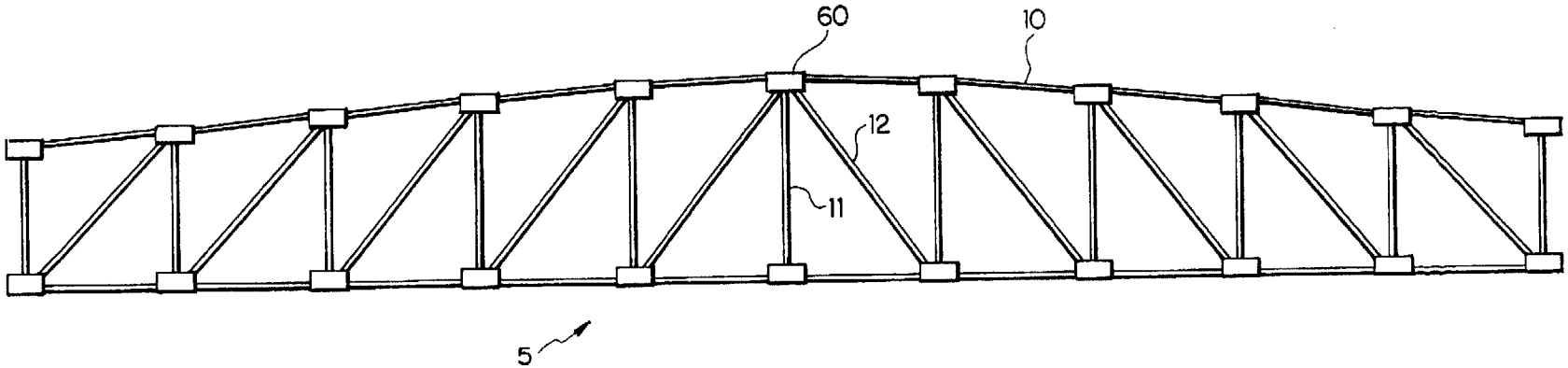
FIG. 5 is a front elevation view of a truss with curved upper horizontal members.

The truss configuration shown in FIG. 1 is typical of one that would be used as a cantilevered rake arm for a clarifier in a water or waste water treatment facility. The truss 1 comprises horizontal main truss members 10, vertical cross-members 11, and cross-members 12, and joints 20A, 20B and 20C.

Figure 2:
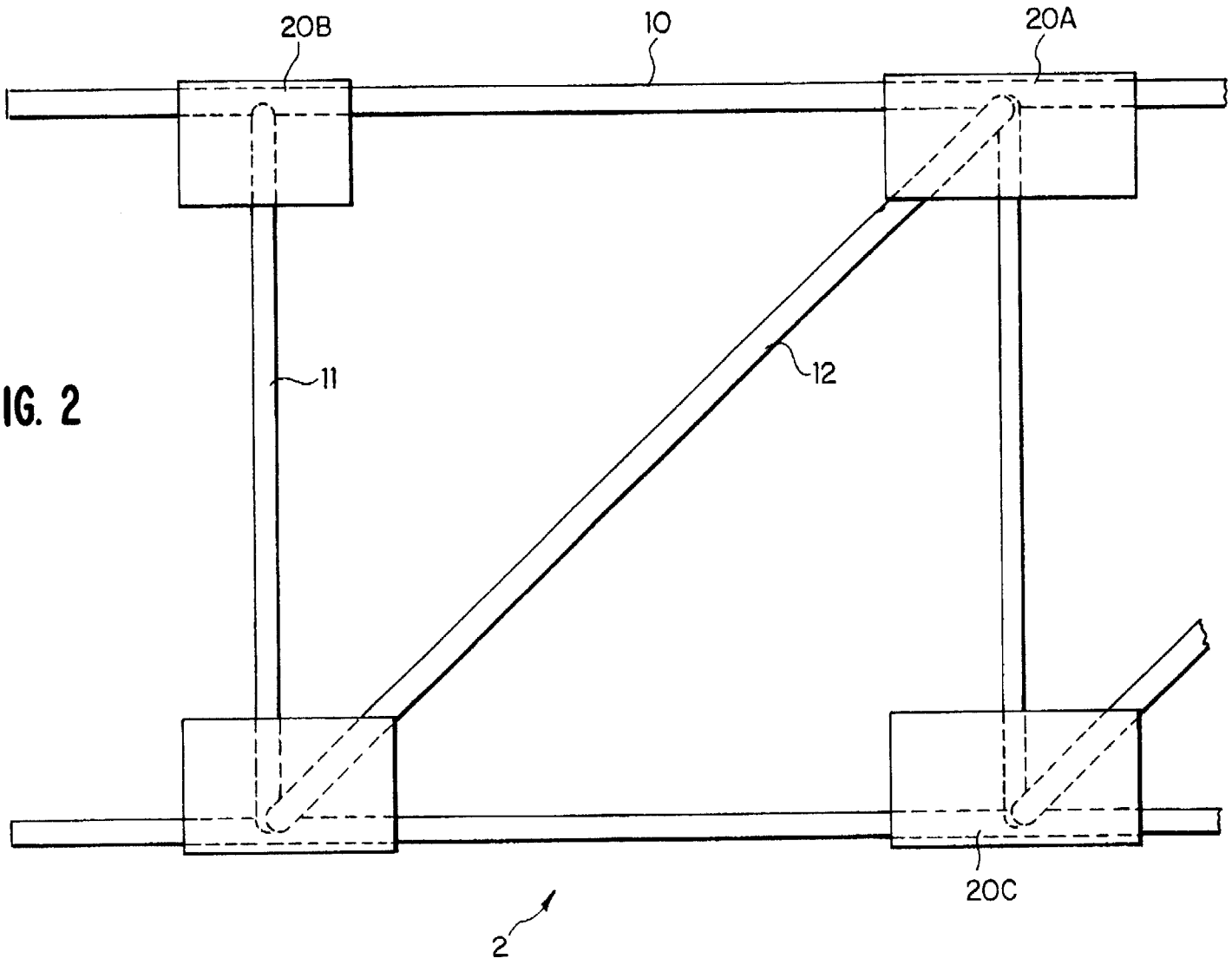
FIG. 2 is a front elevation of a detailed portion of the structure in FIG. 1.

FIG. 2 shows an enlarged view of portion 2 of a front elevation of the truss 1 of FIG. 1. The size of the joint varies depending on how many cross-members 11, 12 come together at that joint, as seen by the illustration of joints 20A, 20B and 20C.

Figure 3:
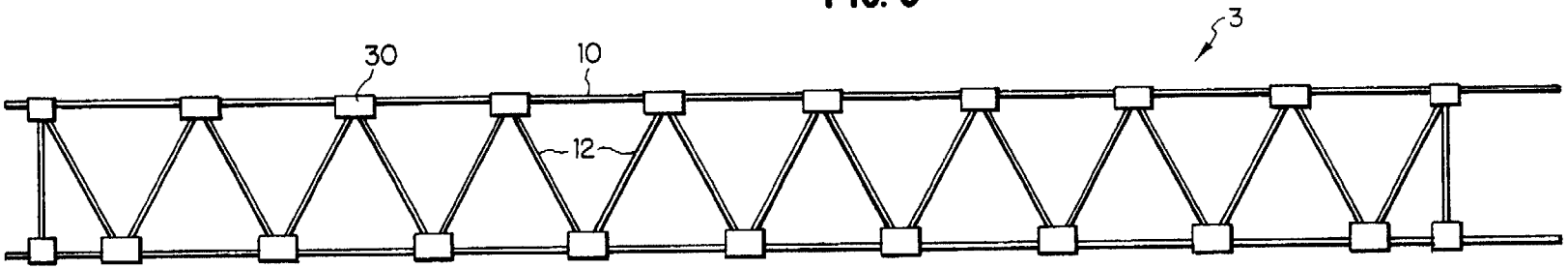
FIG. 3 is a front elevation of a triangular or rectangular truss with all diagonal bracing.

The truss 3 configuration in FIG. 3 is similar to that shown in FIG. 1 except that all of the cross-members 12 are diagonal, forming joint 30. Trusses of this configuration are ideal for concentric loading such as roof or bridge supports.

Figure 4:
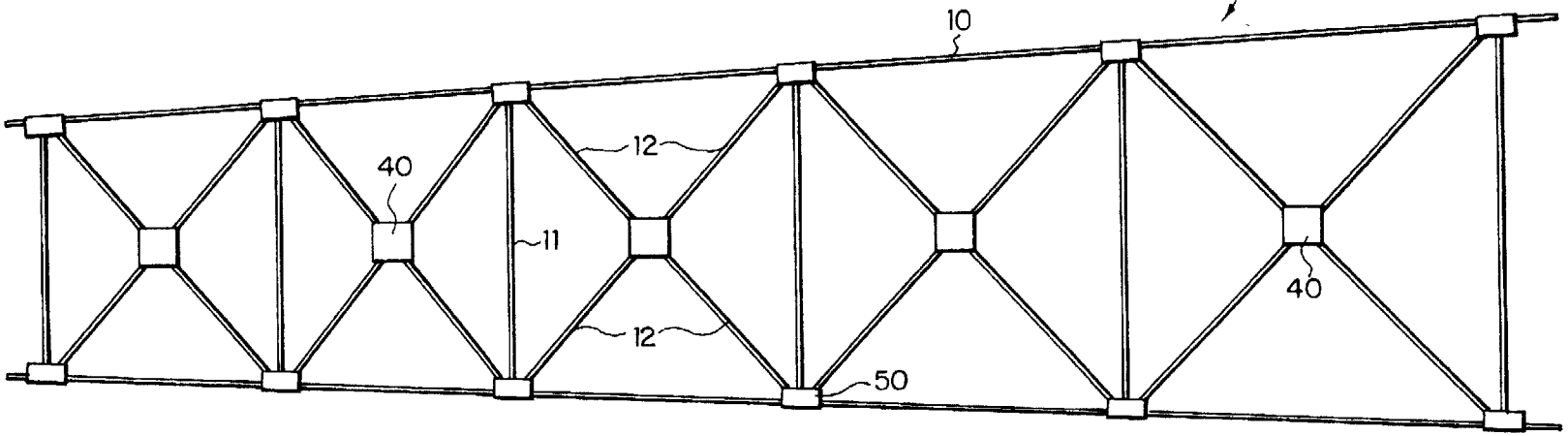
FIG. 4 is a front elevation of a triangular or rectangular tapered truss with cross-diagonal bracing and straight bracing.

A truss 4 configured as in FIG. 4 is similar to all of those above except that the chords of the truss converge at one end. A different bracing scheme is illustrated to show that cross-bracing can be incorporated into truss configurations. With such configuration, short cross-members 12 are joined at a central joint 40 and vertical cross-members 11 provide additional support. The truss of FIG. 4 also includes joints 50 which connect 2 diagonal cross-members 12 and one vertical cross-member 11. Again this bracing scheme can be used in trusses configured as in FIGS. 1–3

Alternatively, the structures in FIGS. 1–3 can be tapered trusses with symmetrical double tapers of the type shown in FIG. 4, or a single taper could be used. Three sides can be tapered, where a triangular truss is used as shown in FIG. 6, or four sides could be tapered on a rectangular truss as shown in FIG. 7. The truss such as shown in FIG. 4 is ideal for tower type structures although all configurations shown can be used whether tapered or not. Curved trusses such as the truss 5 shown in FIG. 5 also may be formed but generally would not be used in tower applications. Truss 5 includes joint 60 formed by two diagonal cross-members 12 and one vertical cross-member 11.

FIGS. 6 and 7 indicate that, in the joint area of the joints 70 and 80, the cross-members 11, 12 abut the longitudinal members 10, which are continuous through the joint areas. The dashed lines in FIG. 7 indicate that a single diagonal cross-member or two diagonal cross-members can used at each bay of the truss. If a single diagonal cross-member is used, the cross-members at adjacent bays can be positioned 90 degrees from each other.

Figure 8:
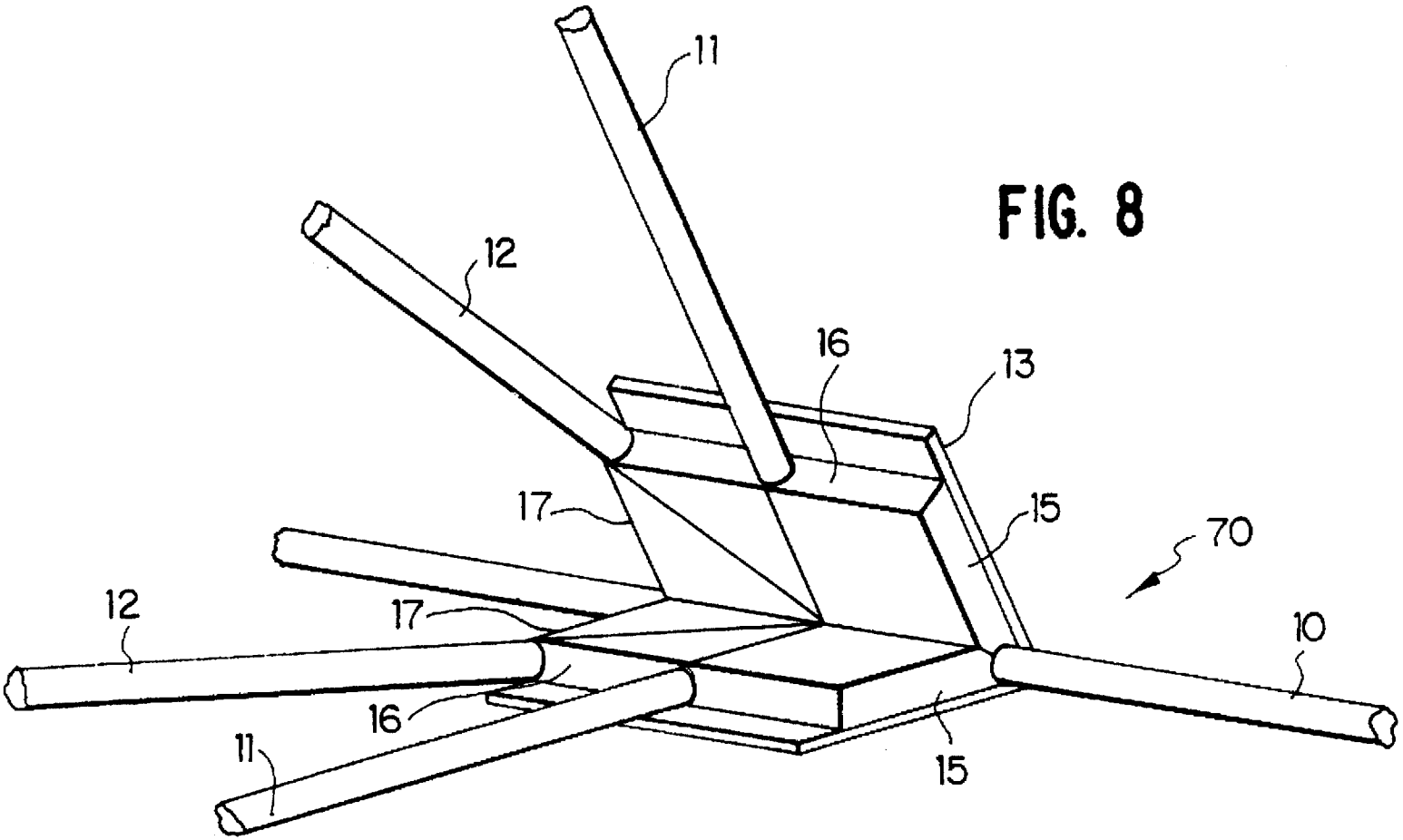
FIG. 8 is an isometric view showing the configuration of the joint of the triangular truss of FIG. 6.
Figure 9B:
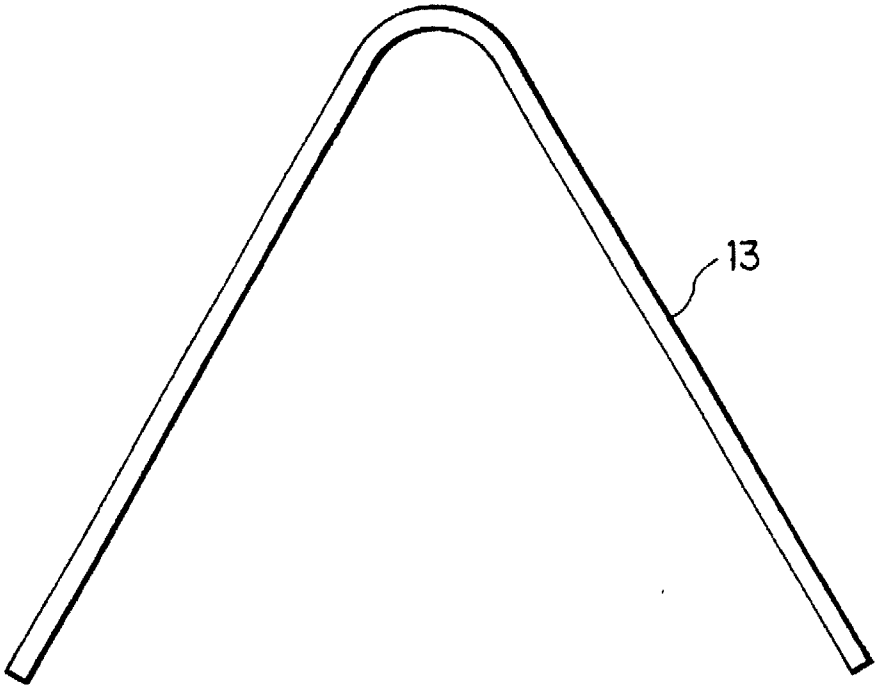
FIGS. 9(*a*)–(*d*) show typical members that would comprise joint components for the joint shown in FIG. 8.
Figure 9A:
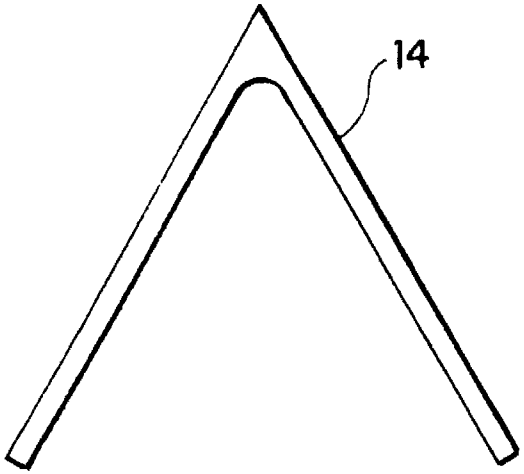
Figure 9C:
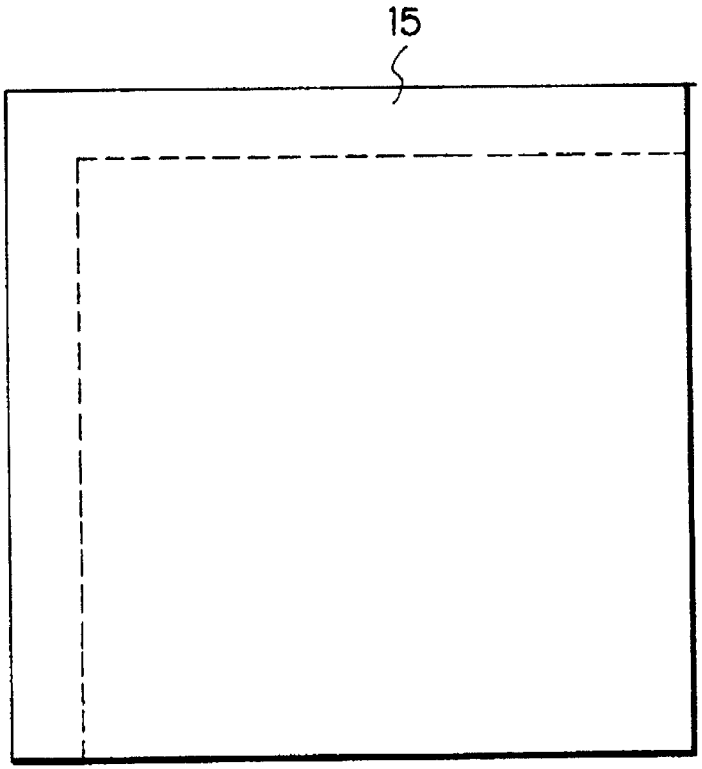
Figure 9D:
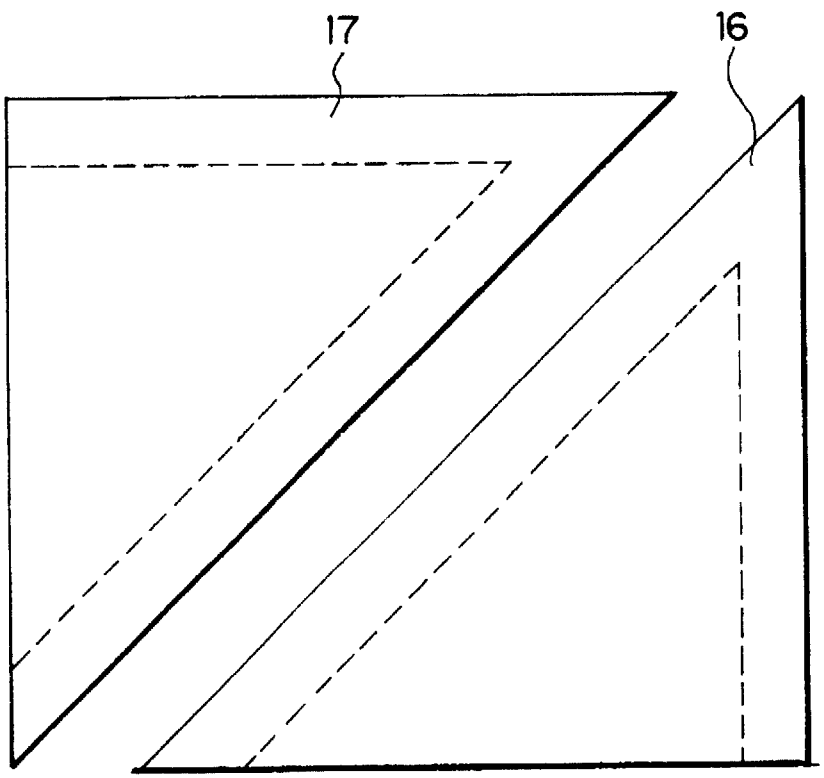
Figure 10B:
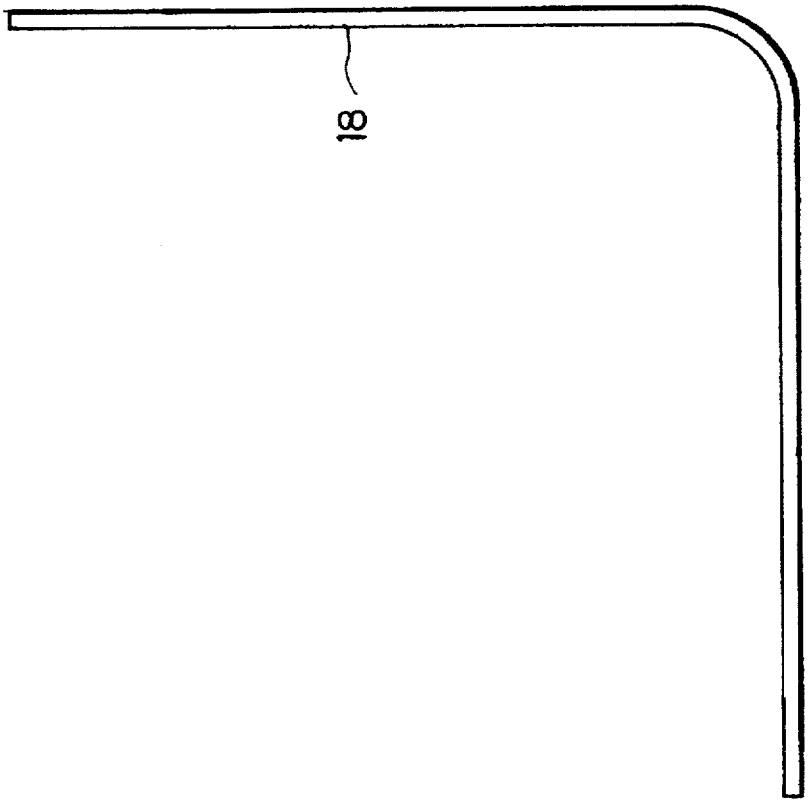
FIGS. 10(*a*)–(*d*) show typical members that would comprise joint components for a rectangular truss of FIG. 3.
Figure 10A:
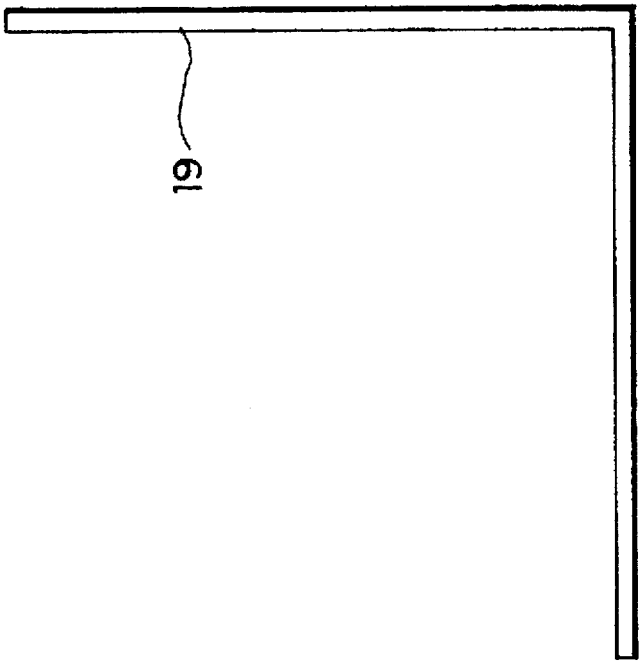
Figure 10C:
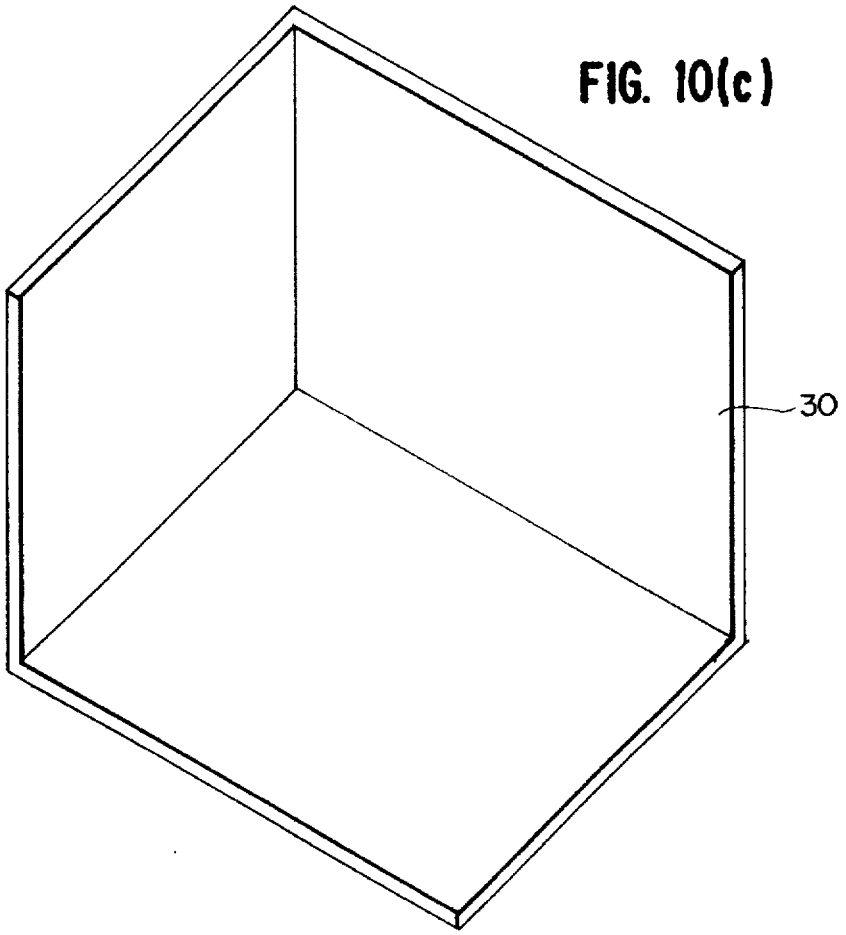
Figure 10D:
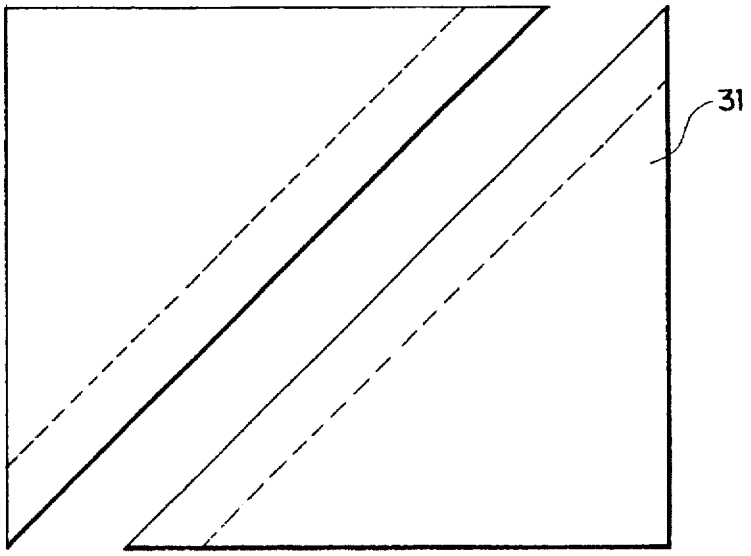

The components and overall configuration of the joint 20A as seen in FIG. 2 are shown in FIG. 8 and FIGS. 9(*a*)–9(*d*). As shown in FIG. 8, side spacers 15 and 17 are disposed between the cross-members 11 and 12, respectively, and the longitudinal members 10 so that the spacers completely surround the cross-members 11 and 12. Center spacers 16 are similarly disposed between the cross members. The spacers are bonded to the cross members and the longitudinal members using an epoxy or any other suitable adhesive.

An outer encapsulation angle member 13 covers the entire outer surface of the spacers and the longitudinal member 10. The joint 20A also includes an inner encapsulation angle member 14, which is not shown in FIG. 8, that completely covers the inner surface of the spacers as shown in FIG. 6. The inner and outer encapsulation members are bonded to the spacers and the longitudinal member 10 with an epoxy or other suitable adhesive. The object of the encapsulation angle members is to tie all of the components of the joint together and to create a sandwich construction with the reinforcement of the outer layers of the joint predominately parallel to or at a diagonal to the anticipated forces, as opposed to perpendicular to the forces.

The spacers 15, 16 and 17 are encapsulated between inner and outer encapsulation angle members 13 and 14. The spacers 15, 16 and 17 have several functions. The spacers provide fixity to the ends of the cross-members 11 and 12 and to the portions of the longitudinal members 10 that are being joined. The spacers also provide a bonding surface to the sides of the cross-members in areas that are not in contact with the encapsulation angle members in order to restrict the ability of the members to pull loose from the joint. This is accomplished by completely encapsulation the members 10, 11 and 12 within the spacers. The spacers also act as a core to the encapsulation angles and serve to create the sandwich construction effect of the joint.

The purpose of constructing the joint in this manner is to provide a monolithic joint which will effectively restrict the ability of any force from any member from causing a failure in the joint. As discussed above, the entire joint can be adhered together with a suitable adhesive such as epoxy or any other adhesive capable of withstanding anticipated stresses. Bolting or riveting can be used in addition to the adhesives but are not necessarily required.

The use of rivets or bolts make it possible to remove the truss from the fixture used to make the truss before the adhesive is set. This makes it possible to utilize the fixture to construct another truss without waiting for the adhesive in the first truss to set.

The cross-section shape of members 10, 11 and 12 dictate the configuration of the accompanying encapsulation angle members 13 and 14, as well as spacer members 15, 16 and 17.

Figure 11C:
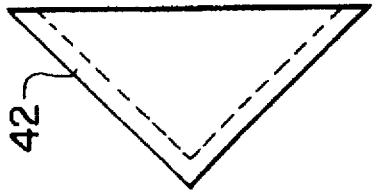
FIGS. 11(*a*)–11(*c*) shows typical members that would comprise joint components for a cross-diagonal joint shown in FIG. 4.
Figure 11B:
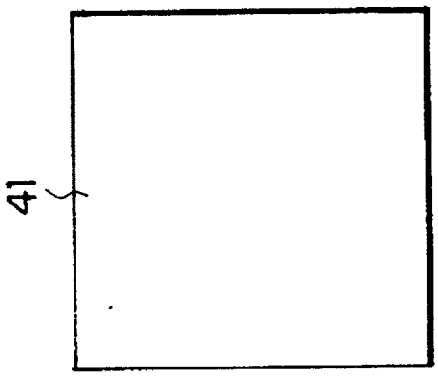
Figure 11A:
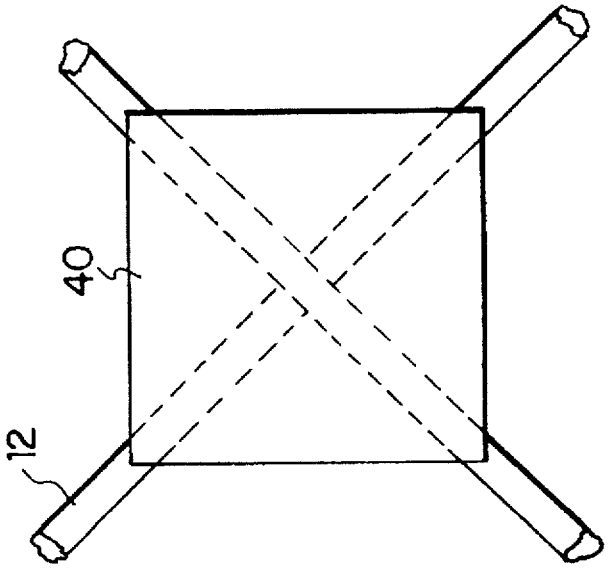

FIGS. 10(*a*)–(*d*) and FIGS. 11(*a*)–(*c*). likewise show the components comprising the rectangular joint 30 of FIG. 3 and joint 40 of FIG. 4, respectively. Joints 30 40 similarly include all the components as joint 20A (see FIG. 8), i.e., an inner and outer encapsulation angle members 19 and 18, respectively, with blocking spacers completing the encapsulation of the joint area.

Figure 12:
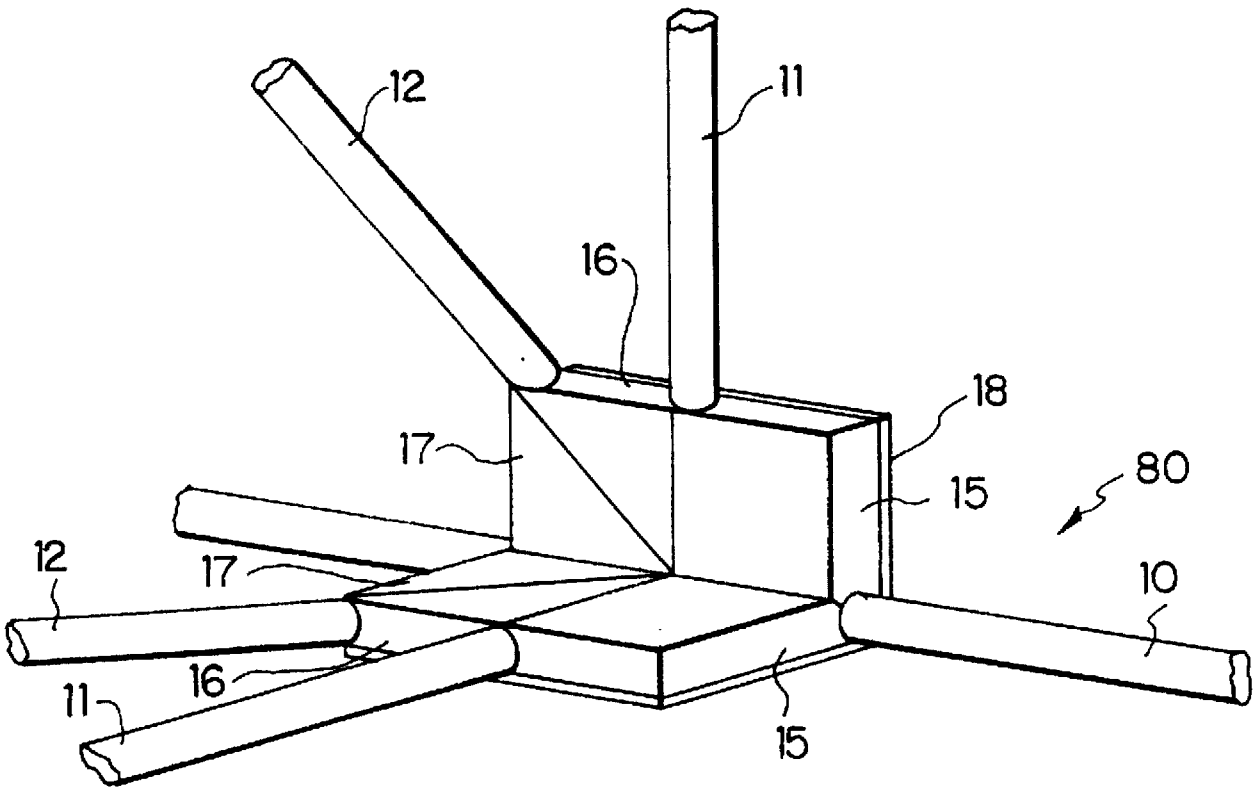
FIG. 12 is an isometric view showing the configuration of the joint of the rectangular truss of FIG. 7.

FIG. 12 shows an isometric view of joint 80 of FIG. 7. As shown in FIG. 8 for joint 70, joint 70 includes side spacers 15 and 17 disposed between the cross-members 11 and 12 and the longitudinal members 10. Center spacers 16 are disposed between the cross members 11 and 12. The spacers completely surround the cross-members and longitudinal members. The spacers are bonded to the cross-members and the longitudinal members. Also, the cross-members and longitudinal members are bonded to one another to create a monolithic joint construction.

Joint 80 also includes an outer encapsulation angle 18 which covers the entire outer surface of the spacers. The joint 80 also includes an inner encapsulation angle member 19, which is not shown in FIG. 12, that completely covers the inner surface of the spacers as shown in FIG. 7. The object of the encapsulation angle members is to tie all of the components of the joint together and to create a sandwich construction with the reinforcement of the outer layers of the joint predominately parallel to or at a diagonal to the anticipated forces, as opposed to perpendicular to the forces.

Figure 13:
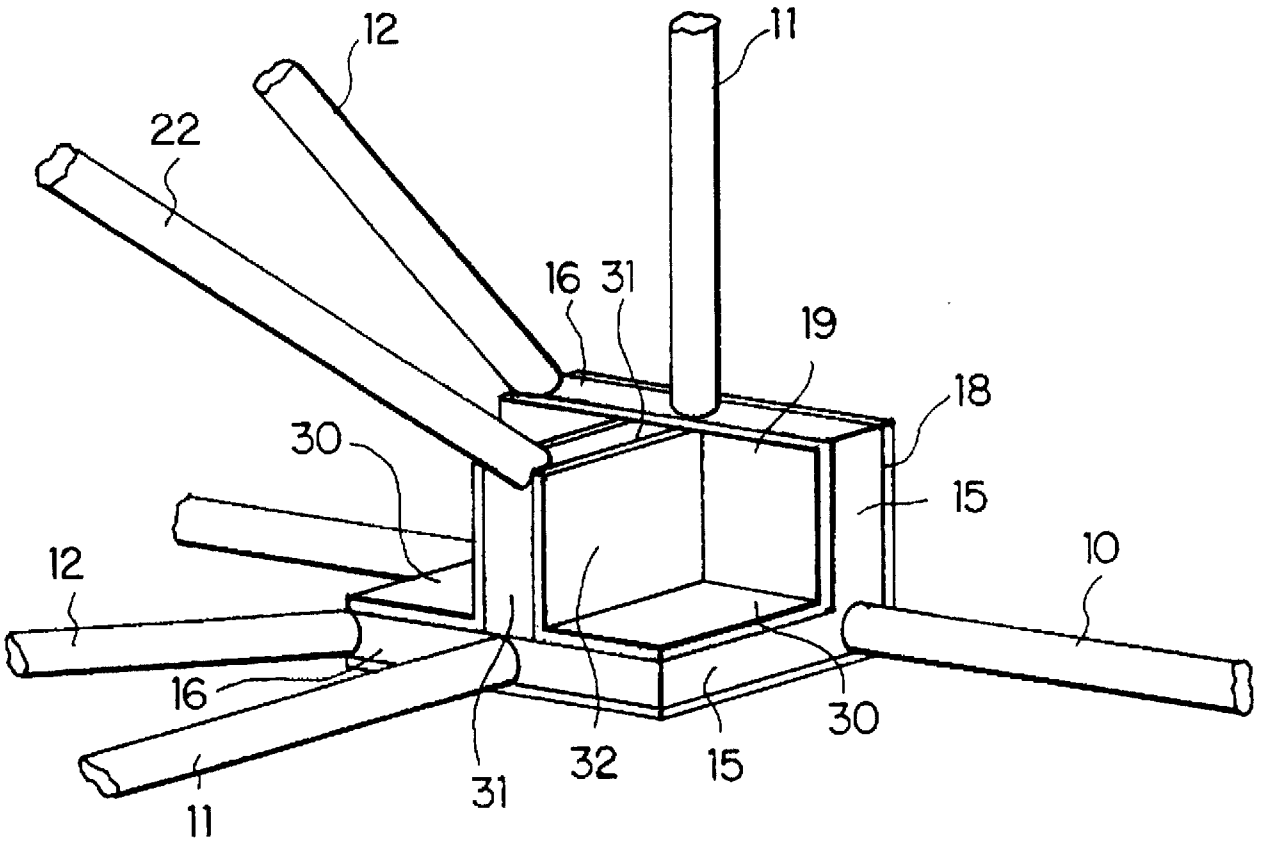
FIG. 13 is an isometric view of a joint similar to the joint of FIG. 12 with an interior diagonal cross-member.

FIG. 13 is similar to FIG. 12, but further includes an interior cross-member 22 positioned on the inside of the rectangular truss so that it spans the cross-section of the rectangular truss. The interior cross-member 22 is encapsulated by interior spacers 31, which are shown in FIG. 10(*d*). Interior encapsulation plates 32 encapsulate the interior spacers 31, thus forming a sandwich construction.

Figure 14:
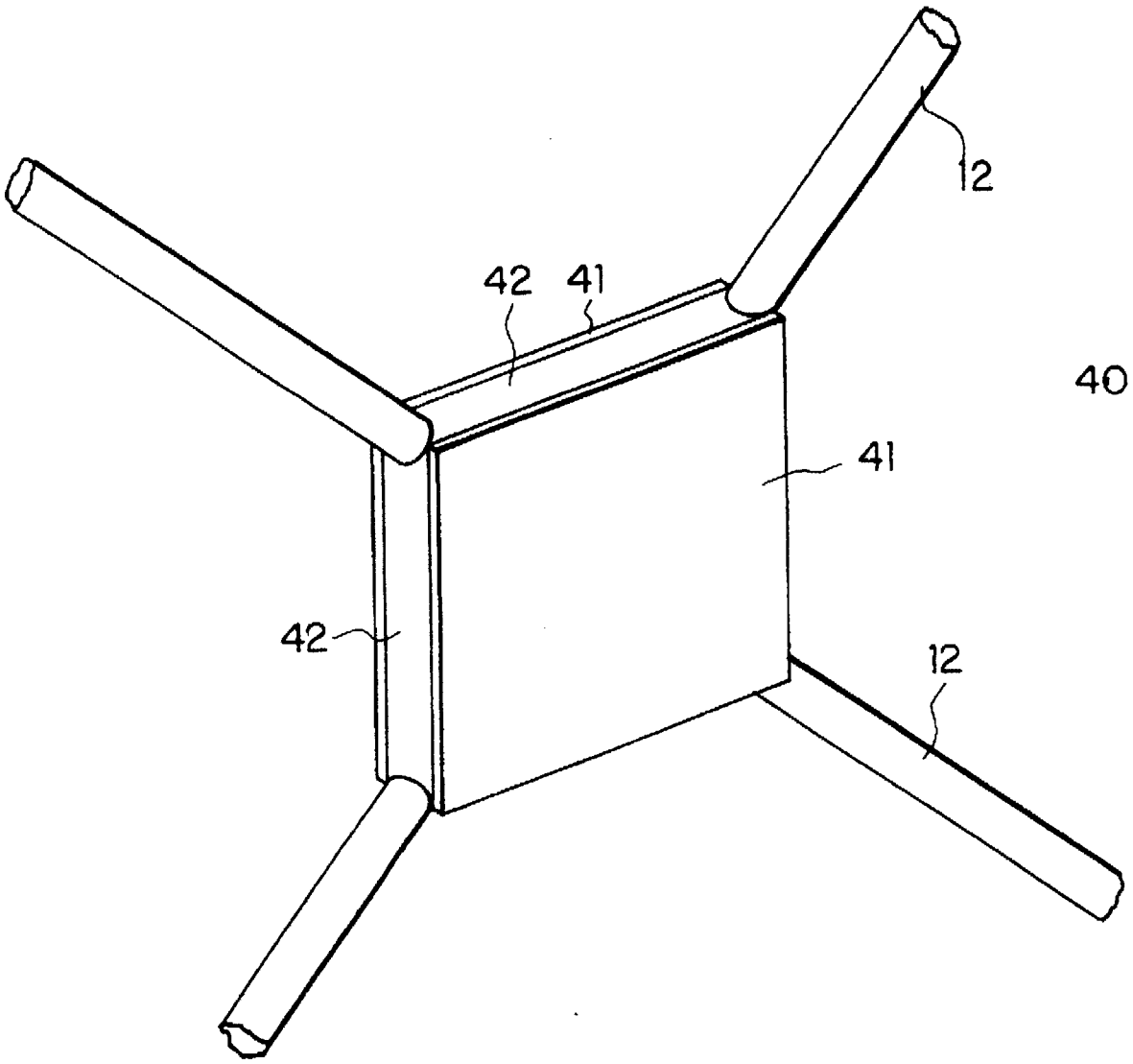
FIG. 14 is an isometric view of a cross-bracing joint.

FIG. 14 shows an isometric view of joint 40 of FIGS. 4 and 11. As shown in FIG. 14, joint 40 includes spacers 42 disposed between the diagonal cross-members 12. The spacers 42 completely surround and are bonded to the diagonal cross-members 12. The diagonal cross-members 12 are bonded to one another to create a monolithic joint construction. Joint 40 also includes an encapsulation plates 41 which cover the entire outer surface of the spacers. The encapsulation plates 41 tie all of the components of the joint together to create a sandwich construction.

Figure 15A:
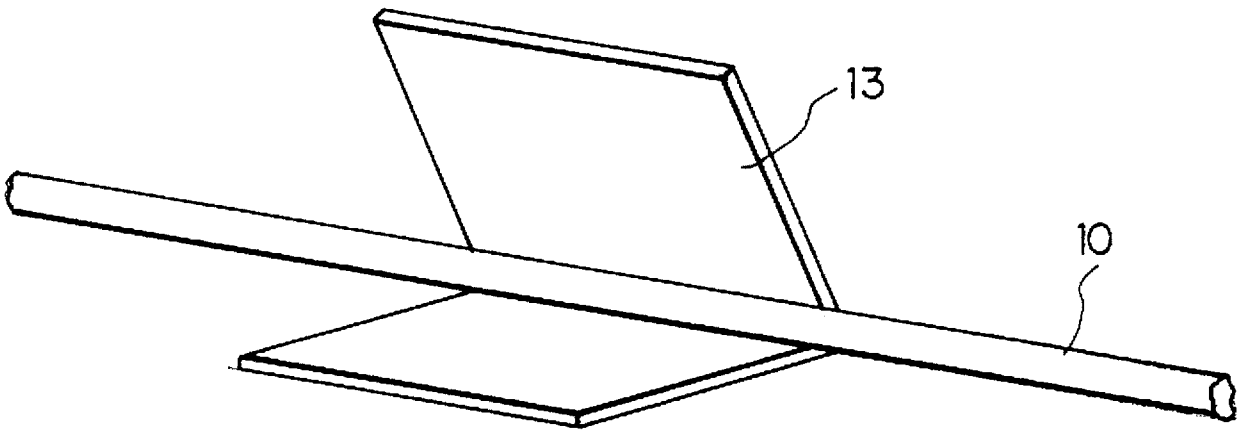
FIGS. 15(*a*)–(*c*) show the joint of FIG. 12 at several steps in the manufacturing process.
Figure 15B:
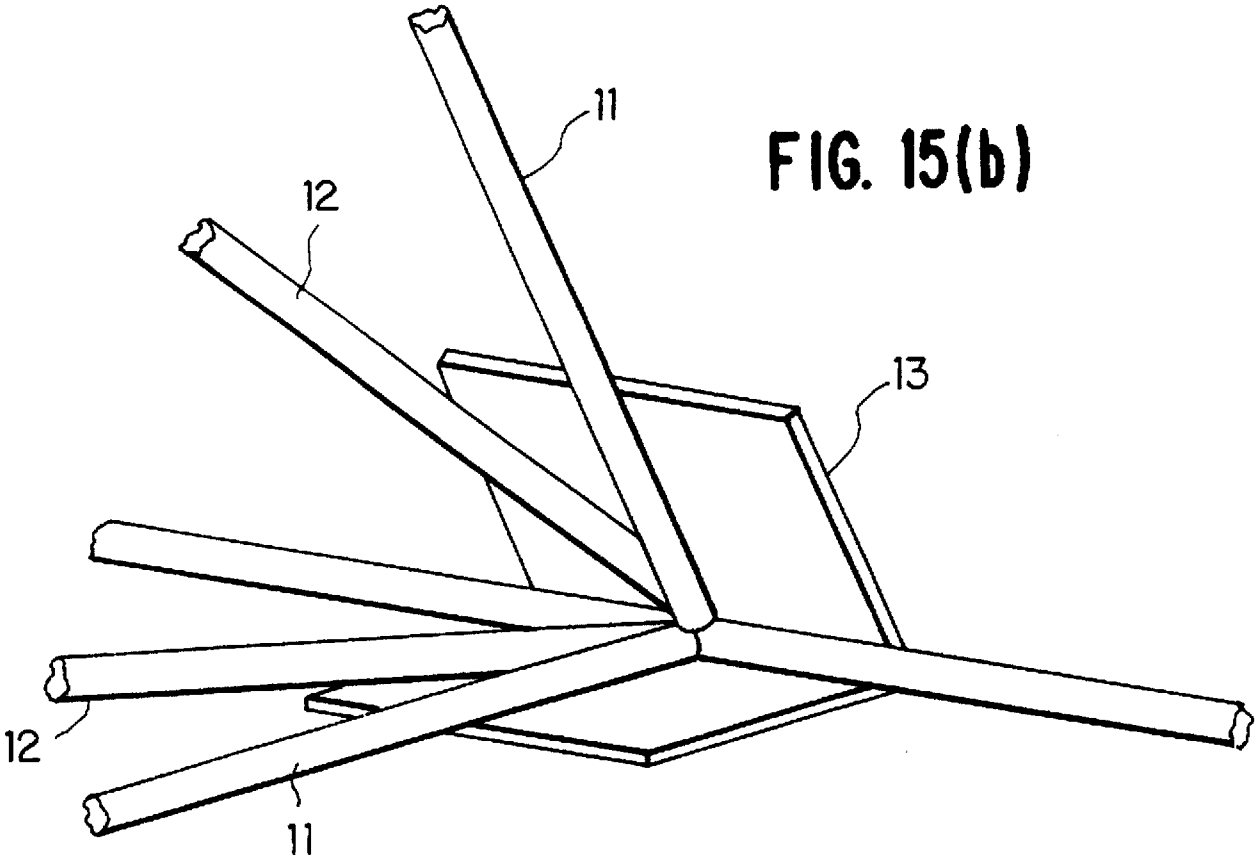
Figure 15C:
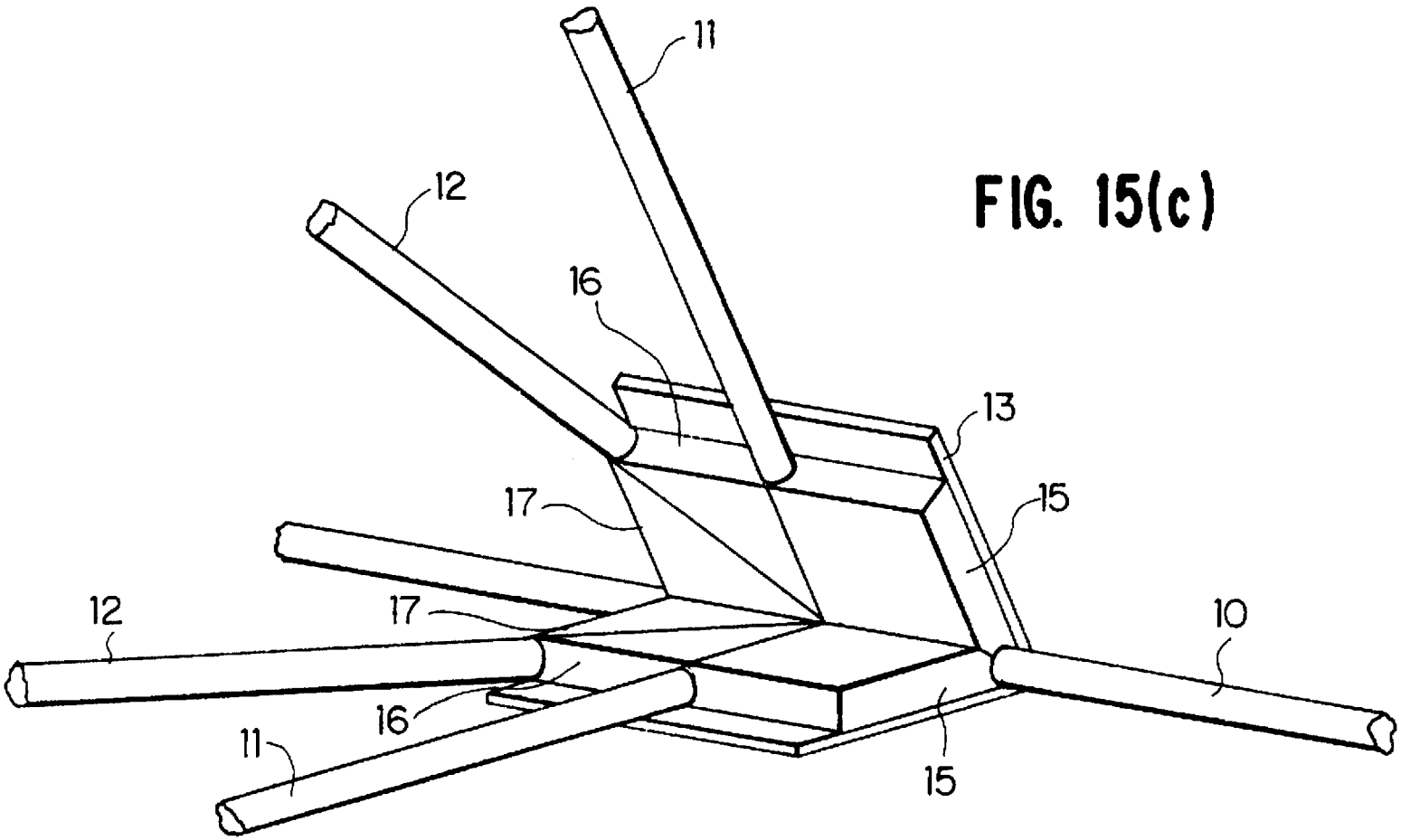

The method of manufacturing a truss of the present invention will now be described. The first step is to construct a fixture corresponding to the desired truss design. The fixture makes it possible to align the truss members in a plane as the truss is constructed. Next, the outer encapsulation angle members 13 are placed on the fixture at the appropriate locations. The longitudinal members 10 are then attached to the outer encapsulation angle members 13 as shown in FIG. 15(*a*) using clamps or the like and an adhesive such as epoxy. As shown in FIG. 15(*b*), the cross-members are then placed in the appropriate position, utilizing clamps or the like, and fixed to the outer encapsulation angle members using an adhesive.

Next, as illustrate in FIG. 15(*c*), the spacers 15, 16 and 17 are placed between the truss members and flush with the outer encapsulation angle members 13. Then the spacers are attached to the truss members and the outer encapsulation angle members 13 with an adhesive. As a final step, the inner encapsulation angle members 14 are adhered to the spacers using an adhesive. To prevent the truss from bonding to the fixture, the fixture can be wrapped with polyethylene.

The longitudinal members, cross-members, encapsulation angles and spacers can be made of any commercially available reinforced composite material comprising a binder material and a reinforcing material. Examples of suitable binder materials are: polyester, vinyl ester, epoxy, or any other suitable thermal plastic or other thermal setting resin. Examples of suitable reinforcing materials are fiberglass, carbon fiber, kevlar, or any other high strength fiber material.

It is preferred that longitudinal members be anisotropic members with reinforcement continuous in the longitudinal direction for maximum strength in that direction. Cross-members should be similar to longitudinal members in construction. The members 10, 11 and 12 could have cross-sectional shapes of any one of the following: square, elliptical, oval, triangular or any other polygon shape as well as a hollow polygon. Also, these members can be of solid or hollow construction. Solid shapes will be preferred in most instances since hollow shapes have inherent buckling problems. Hollow members would be used when the cross-section of the member has to be larger than practical with a solid construction. The preferred method of manufacture of the solid members is pultrusion. When pultrusion is used to fabricate solid members, the preferred reinforcing material is "rovings". The preferred method of manufacture of the hollow members is filament winding. Encapsulation angles should have bi-directional reinforcement with the majority strength in the crosswise direction. The preferred method of manufacture for the encapsulation angles is either filament winding or resin transfer molding, although hand-lay up, spray up, pultrusion, or compression molding could be used.

The preferred method of manufacture of the spacers is resin transfer molding or compression molding, although hand-lay up, spray up, or gluing and cutting of a molded or pultruded plate could be used. Spacers can be either isotropic or anisotropic depending on the stress requirements. The preferred orientation of the reinforcing fibers in the spacers is a random-orientation. However, the effectiveness of the spacers is mostly determined by the strength of the adhesion between the spacers and the encapsulation angles.

Fiberglass composites are extremely beneficial for use in communication towers or for supporting electric utility lines since they are electrically non-conductive and RF transparent. When conductivity is desirable or if higher strength to weight is required graphite/carbon fiber reinforcement can be used in lieu of fiberglass composites. However, graphite/carbon fiber composites and Kevlar composites are much more expensive than fiberglass. Binding resins offer different advantages in strength, compatibility with reinforcements chosen, corrosion resistance, cost, and compatibility with application. Selection of binding resins will vary from application to application.

Various modifications and variations could be made to the present invention without departing from the scope or spirit of the invention.

What is claimed is:

1. A load bearing truss comprising truss members which intersect to form monolithic joints, each of said monolithic joints comprising:

encapsulation angle members covering said truss members at said monolithic joint; and spacers disposed between said encapsulation angle members, wherein portions of said truss members within said monolithic joint are surrounded by said spacers thereby rigidly securing said truss members to said monolithic joint and wherein said encapsulation angle members are secured to said spacers.

2. The truss of claim 1 wherein said truss members which intersect to form monolithic joints are encapsulated and secured to one another.

3. The truss of claim 1 wherein said truss members and said encapsulation angle members are adhesively bonded to said spacers.

4. The truss of claim 1 wherein sections of said truss members within said joint that are not in contact with said encapsulation angle members are bonded to said spacers.

5. The truss of claim 1 wherein said truss members, said spacers and said encapsulation angle members are made from a composite material.

6. The truss of claim 1 wherein said truss members have a cross-sectional shape selected from the following group: square, round, elliptical, oval and triangular.

7. A load bearing truss comprising:

truss members, said truss members intersecting at encapsulated joints;

encapsulation angle members covering said truss members at said encapsulated joints;

spacers disposed between said encapsulation angle members, wherein portions of said truss members within said encapsulated joint are surrounded by said spacers thereby rigidly securing said truss members to said joint and wherein said encapsulation angle members are secured to said spacers; and an adhesive substance encapsulating said truss members and spacers, forming a monolith.

8. A monolithic joint for a load bearing truss, said load bearing truss comprising truss members intersecting at said monolithic joint, said monolithic joint comprising:

encapsulation angle members for covering truss members at said monolithic joint;

spacers disposed between said encapsulation angle members, wherein portions of truss members within said monolithic joint are surrounded by said spacers thereby rigidly securing truss members to said monolithic joint and wherein said encapsulation angle members are secured to said spacers.

9. The joint of claim 8 wherein said truss members intersecting at said monolithic joint are encapsulated and secured to one another.

10. The joint of claim 8 wherein said truss members and said encapsulation angle members are adhesively bonded to said spacers.

11. The joint of claim 8 wherein sections of said truss members within said joint that are not in contact with said encapsulation angle members are bonded to said spacers.

12. The joint of claim 8 wherein said truss members, said spacers and said encapsulation angle members are made from a composite material.

13. The joint of claim 8 wherein said truss members have a cross-sectional shape selected from the following group: square, round, elliptical, oval and triangular.

14. A joint for a load bearing truss, said load bearing truss comprising truss members intersecting at said joint, said joint comprising:

an outer encapsulation angle member for covering an outer surface of said joint in at least two planes;

an inner encapsulation angle member for covering an inner surface of said joint in at least two planes;

spacers disposed between said encapsulation angle members, wherein portions of truss members within said joint are surrounded by said spacers thereby rigidly securing truss members to said joint and wherein said encapsulation angle members are secured to said spacers, thereby forming a sandwich construction having structures in multiple planes.

15. A joint for a load bearing truss, said joint comprising:

longitudinal members extending in a longitudinal direction and cross members intersecting said longitudinal members to form said joint;

center spacers disposed between said cross members of said joint and secured to said cross members, wherein said center spacers extend in a first and second plane parallel to said longitudinal direction, said first and second planes being formed by the intersection of said cross members and said longitudinal members;

side spacers disposed between said cross members and said longitudinal members of said joint and adjacent to said center spacers, wherein said side spacers extend in said first and second planes, said side spacers are secured to said cross members and said longitudinal members, and portions of said cross members and said longitudinal members are surrounded by said side spacers and said center spacers thereby rigidly securing said cross members and said longitudinal members in said joint;

an outer encapsulation angle member secured to an outer surface of said center and side spacers, wherein said outer encapsulation member extends in planes parallel to said first and second planes;

an inner encapsulation angle member secured to an inner surface of said center and side spacers, wherein said inner encapsulation angle member extends parallel to said outer encapsulation angle member, and wherein said side spacers and said center spacers are disposed between said inner and said outer encapsulation angle members, thereby forming a sandwich construction.

16. The joint of claim 15 wherein said longitudinal members and said cross members are fixed to one another.

17. The joint of claim 15 wherein said joint further comprises:

an interior cross member spanning a cross-section of said joint;

an interior spacer extending in a plane perpendicular to a longitudinal direction, said spacer completely surrounding a portion of said interior cross member; and interior encapsulation plates for encapsulating said interior spacer.

18. A joint for a load bearing truss, said joint comprising:

longitudinal members extending in a longitudinal direction and cross members intersecting said longitudinal members to form said joint;

side spacers disposed between said cross members and said longitudinal members of said joint, wherein said side spacers extend in a first and second plane parallel to said longitudinal direction, said first and second planes being formed by the intersection of said cross members and said longitudinal members; said side spacers are secured to said cross members and said longitudinal members; and portions of said cross members and said longitudinal members are surrounded by said side spacers thereby rigidly securing said cross members and said longitudinal members to said joint;

an outer encapsulation angle member secured to an outer surface of said side spacers, wherein said outer encapsulation member extends in planes parallel to said first and second planes;

an inner encapsulation angle member secured to an inner surface of said side spacers, wherein said inner encapsulation angle member extends parallel to said outer encapsulation angle member, and wherein said side spacers are disposed between said inner and said outer encapsulation angle members thereby forming a sandwich construction.

19. The joint of claim 18 wherein said longitudinal members and said cross members are fixed to one another.

20. The method of manufacturing a truss comprising longitudinal members and cross members, said method comprising the following steps;

constructing a fixture corresponding to a desired truss design;

placing outer encapsulation angle members on the fixture;

attaching the longitudinal members to the outer encapsulation angle members;

attaching the cross members to the outer encapsulation angle members and to said longitudinal members;

placing spacers adjacent to the outer encapsulation angle members such that the spacers surround portions of the longitudinal members and the cross members;

attaching the spacers to the longitudinal members, the cross members and the outer encapsulation angle members; and attaching inner encapsulation angle members to the spacers thereby forming a sandwich construction wherein said spacers are disposed between said inner and said outer encapsulation angle members.

21. The method of claim 20 wherein said attaching steps are performed using an adhesive epoxy.

22. The method of claim 20 further comprising the step of fixing said inner and outer encapsulation angle members to said spacers using a fastener selected from the group consisting of rivets and bolts.

23. The method of claim 22 wherein said fixing step is performed after attaching said inner encapsulation angle members to said spacers.

* * * * *